US006830636B2

(12) United States Patent
Sakamoto et al.

(10) Patent No.: US 6,830,636 B2
(45) Date of Patent: Dec. 14, 2004

(54) HIGH TOUGHNESS AMORPHOUS ALLOY STRIP AND PRODUCTION THEREOF

(75) Inventors: Hiroaki Sakamoto, Kawasaki (JP); Toshio Yamada, Kawasaki (JP); Takashi Sato, Kawasaki (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/286,734

(22) Filed: Nov. 1, 2002

(65) Prior Publication Data

US 2003/0047249 A1 Mar. 13, 2003

Related U.S. Application Data

(62) Division of application No. 08/741,577, filed on Oct. 30, 1996, which is a continuation of application No. 08/317,269, filed on Oct. 3, 1994, now abandoned.

(30) Foreign Application Priority Data

Oct. 4, 1993 (JP) ..... 5-248068

(51) Int. Cl.[7] ..... C22C 45/02
(52) U.S. Cl. ..... 148/403; 148/304
(58) Field of Search ..... 148/304, 403; 428/606

(56) References Cited

U.S. PATENT DOCUMENTS

| | | | | |
|---|---|---|---|---|
| 4,142,571 A | | 3/1979 | Narasimhan | 164/88 |
| 4,581,081 A | * | 4/1986 | Kroeger et al. | 148/403 |
| 4,587,507 A | | 5/1986 | Takayama et al. | 336/178 |
| 4,615,732 A | * | 10/1986 | Shastry et al. | 148/403 |
| 4,766,947 A | | 8/1988 | Shibuya et al. | 164/460 |
| 4,865,664 A | * | 9/1989 | Sato et al. | 148/403 |
| 5,496,418 A | * | 3/1996 | Ramanan et al. | 148/304 |

FOREIGN PATENT DOCUMENTS

| | | |
|---|---|---|
| EP | 0515483 | * 12/1992 |
| JP | 56-33443 | 4/1981 |
| JP | 60-255243 | 12/1985 |
| JP | 61-153266 | 7/1986 |
| JP | 61-212449 | 9/1986 |

OTHER PUBLICATIONS

*J. Appl. Phys.*, 55(6), Mar. 15, 1984, pp. 1787–1789, "Dependence Of Some Properties On Thickness Of Smooth Amorphous Alloy Ribbon", H.H. Liebermann et al.

(List continued on next page.)

*Primary Examiner*—George Wyszomierski
(74) *Attorney, Agent, or Firm*—Kenyon & Kenyon

(57) ABSTRACT

A process of producing a high toughness iron-based amorphous alloy strip, using a single roll liquid quenching method, the strip having a thickness of more than 55 μm up to 100 μm and a width of 20 mm or more and having a fracture strain $\epsilon_f$ satisfying the relationship $\epsilon_f>0.1$ where $\epsilon_f=t/(D-t)$, t=thickness of the strip, and D=bent diameter upon fracture, $\epsilon_f$ being determined by bending the strip with a free cooling surface thereof facing outward, the process comprising the steps of: ejecting a molten metal alloy through a nozzle; applying the ejected molten metal alloy to a surface of a rotating roll; allowing the applied molten metal alloy to be quenched by the roll surface to form an amorphous strip of the metal alloy, the strip being quenched at a cooling rate, determined at a free surface thereof, of $10^{3°}$ C./sec or more in a temperature range of from 500° C. to 200° C.; and continuously coiling the quenched strip at a temperature of 200° C. or lower.

2 Claims, 2 Drawing Sheets

OTHER PUBLICATIONS

*Research Institute For Iron, Steel and Other Metals*, *1737th Report*, Apr. 30, 1981, pp. 351–358, "Critical Thickness For Formation Of Fe–Ni–Co–Based Amorphous Alloys and Metaloids", M. Higiwara et al.

*Rapid Solidification Technology For Reduced Consumption Of Strategic Materials*, 1984, pp. 1–5, J.E. Flinn.

*Science Reports, Tohoku University*, Series A, vol. 29, No. 2, Jun. 1981, pp. 351–358, M. Hagiwara et al.

*Amorphous Alloys–Properties And Application*, 1981, pp. 6–9, T. Masumoto et al., with partial translation of pp. 8–9.

*Rapidly Quenched Metals*, vol. 1, 1978, pp. 1–21, "Rapid Quenching Techniques And Formation Of Metalic Glassed", H.A. Davies.

*Encyclopedia Of Chemical Technology*, 4th Ed., vol. 12, 1994, pp. 656 and 663–665, "Glassy Metals".

*Rapidly Solidified Metals*, 1987, pp. 1–35, T.R. Ananthar-man et al.

*Proc. 4th Int. Conf. On Rapidly Quenched Metals*, 1981, pp. 15–18, "Preparation Of Amorphous Composite Alloys", S. Shimanuki, et al.

* cited by examiner

HIGH TOUGHNESS AMORPHOUS ALLOY STRIP AND PRODUCTION THEREOF

This is a division under 35 U.S.C. §120 and §121 of prior Application No. 08/741,577 filed Oct. 30, 1996, wherein a continued prosecution application (CPA) under 37 C.F.R. §1.53 (d) for Application No. 08/741,577 was filed on Aug. 6, 1998, and Application No. 08/741,577 filed Oct. 30, 1996 is a continuation under 37 C.F.R. §1.62 of Application No. 08/317,269 filed Oct. 3, 1994 (now abandoned).

BACKGROUND OF THE INVENTION

1. Field of the Invention

The present invention relates to a high toughness amorphous alloy strip having a large thickness and a process of producing the strip using a single-roll liquid-quenching method.

2. Description of the Related Art

There are known methods for continuously producing strips by quenching a molten metal alloy, such as centrifugal quenching methods, single roll methods, and twin-roll methods. These methods include supplying a molten metal, through an orifice, onto an inner or outer circumferential surface of a rapidly rotating metal drum or roll, thereby rapidly solidifying the molten metal to form a strip or wire. Proper selection of alloy composition provides an amorphous metal alloy having a structure like a liquid metal.

Amorphous alloys are drawing attention for their characteristic properties and some of them are practically used. However, to establish an amorphous structure, a molten metal must be cooled at a high cooling or solidification rate, so that the product strip generally has a small thickness. This restricts the application of amorphous metal alloys.

It is known that the maximum possible thickness of amorphous metal alloys depends on the alloy composition. Hagiwara et al. obtained a 250 $\mu$m thick, 1 mm wide strip of an Fe—Si—B alloy by using a single roll method, which is a single side cooling method (Sci. Rep. Res. Inst. Tohoku Univ. A-29(1981), 351). However, it is empirically known that such a thick strip cannot be obtained with a practically available strip width of 20 mm or more. In the conventional single roll method, it is generally believed that the strip thickness can be varied by the manufacturing parameters of (1) the width of nozzle opening measured in the roll rotation direction, (2) the ejection pressure of molten metal, (3) the distance between the nozzle and the roll surface, and (4) the circumferential speed of roll. However, merely varying these parameters did not provide a strip thickness more than 45 $\mu$m when the strip width is 25 mm. If a thicker strip is forcibly produced with these parameters outside proper ranges, the strip has poor shape, surface, magnetic, and mechanical properties. It is thus extremely difficult to produce a practically available wide and thick amorphous metal alloy strip.

J. Appl. Phys., Vol. 55, 1787 (1984) reported that a 25.4 mm wide, 80 $\mu$m thick strip was obtained. An as-quenched strip of an $Fe_{80}B_{14.5}Si_{3.5}C_2$ alloy had a bending fracture strain $\epsilon_f$ which was reduced, with an increase of the strip thickness, to as small as 0.01 when the strip thickness was 40 $\mu$m or more. The fracture strain $\epsilon_f$ is defined by $\epsilon_f = t/(D-t)$, where t represents the strip thickness and D represents the bending radius upon fracture. For example, when a 60 $\mu$m thick strip has a fracture strain of 0.01, this means that the strip cannot be coiled around a cylinder having a diameter of 6 mm or less. This causes a drawback in fabricating a coiled core of transformers, not only because the radius of bending the strip at the corners of the coil is limited but also because breakage of the strip being coiled frequently occurs.

To reduce the occurrence of cracking during blanking an amorphous alloy strip, Japanese Unexamined Patent Publication (Kokai) No. 61-153266 disclosed a process in which a solidified strip is detached or separated from the cooling roll surface at a position distant from a molten metal application point, the distance being the longer of ¼ of the roll circumferential length and 10 cm. This publication, however, describes nothing about the strip temperature and moreover, the strips provided as examples are made of Co-based amorphous alloys and have a thickness of as small as 30 $\mu$m.

Japanese Unexamined Patent Publication (Kokai) No. 56-33443 disclosed a process in which a solidified strip is detached from the cooling roll surface at a position 30 cm or more distant from the molten metal application point. This publication also describes nothing about the strip temperature and is limitedly directed to Co-based amorphous alloy strips. Moreover, the strips provided as examples have a thickness as small as 27 $\mu$m and there is no reference to the mechanical property.

Thus, there is no conventional amorphous alloy strip which is not only thick but also excellent in the mechanical property and the appearance has been desired.

To provide a solution to this problem, the present inventors have found a process for producing an amorphous alloy strip having a high toughness and a large thickness.

According to Japanese Unexamined Patent Publication (Kokai) No. 60-255243, a multiple slot nozzle is used to produce a quenched strip of an Fe-based amorphous alloy having a large thickness and a high toughness, i.e., a 50 $\mu$m or thicker, 20 mm or wider strip having a bending fracture strain of 0.01 or more as determined by bending the strip with the free cooling surface facing outward. According to Japanese Unexamined Patent Publication (Kokai) No. 61-212449, the strip has a further improved toughness when the strip is quenched at a cooling rate of $10^{3°}$ C./sec or more, determined at the free surface thereof, in a temperature range of from 500 to 300° C. and the thus-solidified strip is detached from a cooling substrate at a temperature of 300° C. or less.

Thus, Japanese Unexamined Patent Publication (Kokai) Nos. 60-255243 and 61-212449 disclosed amorphous alloy strips having an increased thickness and an improved toughness.

However, it is more desirable from practical point of view if the bending fracture strain $\epsilon_f$ equals 1 irrespective of the strip thickness so that the strip can be bent completely onto itself to form a folio. For mass production of amorphous alloy strips to be brought into practice, it is necessary to continuously coil the quenched strips. If the coiling temperature is not controlled as in the conventional processes, it is not ensured to produce a strip having a bending fracture strain $\epsilon_f$ of 1, because the heat of the coiled strip is accumulated in the coil and deteriorates the magnetic and mechanical properties of the strip.

Japanese Unexamined Patent Publication (Kokai) Nos. 60-255243 and 61-212449, in the Examples thereof, describe that $\epsilon_f$ is less than 1 when the strip thickness is more than 55 $\mu$m and the strip unavoidably breaks when used in applications in which the strip must be bent with a small radius. Moreover, when a wide amorphous strip is slit to a narrower width, it was conventionally difficult to avoid breaking of the strip being slitted when the strip is 55 $\mu$m or thicker, irrespective of the process by which the strip was produced. It should be also noted that Japanese Unexamined Patent Publication (Kokai) Nos. 60-255243 and 61-212449 consider nothing about the heat accumulation in a coil and that Japanese Unexamined Patent Publication (Kokai) No. 61-212449 merely controls the temperature at which the solidified strip is detached from the cooling substrate, so that the strip is unavoidably embrittled when continuously coiled.

It is desirable that the above-mentioned drawback in a thick amorphous alloy strip is eliminated and that a high toughness, thick amorphous alloy strip is developed.

SUMMARY OF THE INVENTION

As described above, no conventional thick and wide amorphous alloy strip having a good mechanical property, even when continuously coiled in mass production, is available and no conventionall process of producing such a strip has been developed.

It is the object of the present invention to provide a thick, wide, and high toughness amorphous alloy strip, and a process of producing same, the strip having good mechanical properties, particularly a toughness sufficient for slitting requiring a bending fracture of 1 so that the amorphous alloy strip can be used to fabricate transformer cores or the like without difficulty.

To achieve the object according to the present invention, there is provided a process of producing a high toughness iron-based amorphous alloy strip, using a single roll liquid quenching method, the strip having a thickness of more than 55 $\mu$m up to 100 $\mu$m and a width of 20 mm or more and having a fracture strain $\epsilon_f$ satisfying the following relationship:

$$\epsilon_f > 0.1$$

where $\epsilon_f = t/(D-t)$, t=thickness of the strip, and

D=bent diameter upon fracture, $\epsilon_f$ being determined by bending the strip with a free cooling surface thereof facing outward, the process comprising the steps of:

ejecting a molten metal alloy through a nozzle;

applying the ejected molten metal alloy to a surface of a rotating roll;

allowing the applied molten metal alloy to be quenched by the roll surface to form an amorphous strip of the metal alloy, the strip being quenched at a cooling rate, determined at a free surface thereof, of $10^{3°}$ C./sec or more in a temperature range of from 500° C. to 200° C.; and continuously coiling the quenched strip at a temperature of 200° C. or lower.

Preferably, the strip has a thickness of more than 55 $\mu$m up to 70 $\mu$m and the fracture strain $\epsilon_f$ satisfies the following relationship:

$$\epsilon_f = 1.$$

According to the present invention, there is also provided a high toughness iron-based amorphous alloy strip having a thickness of more than 55 $\mu$m up to 100 $\mu$m and a width of 20 mm or more and has a fracture strain $\epsilon_f$ satisfying the following relationship:

$$\epsilon_f > 0.1,$$

where $\epsilon_f = t/(D-t)$, t=thickness of the strip, and

D=bent diameter upon fracture, $\epsilon_f$ being determined by bending the strip with a free cooling surface thereof facing outward.

DESCRIPTION OF THE PREFERRED EMBODIMENTS

Figures 1A, 1B, 1C:
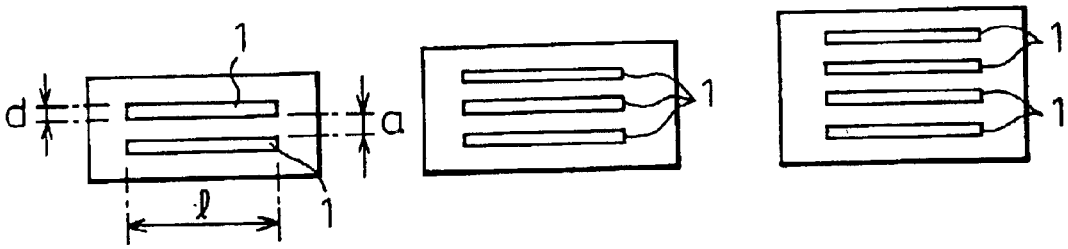
FIGS. 1(A), 1(B) and 1(C) respectively show double-, triple-, quadruple-slot nozzles, used for the present invention, in plan views.

The amorphous alloy strip according to the present invention is produced by applying a molten metal alloy onto a rotating roll to cause the molten metal to be quenched and solidified on the roll and continuously coiling the solidified strip, the strip having a thickness of more than 55 $\mu$m up to 100 $\mu$m. When the strip thickness is not more than 55 $\mu$m, a strip having a bending fracture strain equal to 1 can be produced by the conventional process proposed in Japanese Unexamined Patent Publication (Kokai) No. 61-212449, other than the present invention. It is difficult to establish an amorphous structure throughout a solidified strip, if the strip thickness is more than 100 $\mu$m. Thus, the amorphous alloy strip according to the present invention must have a thickness of more than 55 $\mu$up to 100 $\mu$m. The strip must have a width of 20 mm or more in order to be available in practical application.

The present inventors have found the novel fact that the high toughness of the thick amorphous alloy strip of the present invention is achieved if the solidified strip is quenched at an increased cooling rate in a temperature range below the glass transition temperature thereof and if the strip is coiled at a controlled coiling temperature. With respect to the cooling temperature range, it is significantly important that the quenchin must be carried out at a cooling rate of $10^{3°}$ C./sec or more in the temperature range of from 500 to 200° C. in order to provide the solidified strip with an increased toughness. The cooling rate herein referred means a cooling rate of the free surface of a strip, i.e., the strip surface opposite to that brought into contact with the cooling roll surface.

Although the upper limit of the quenching temperature range should be specified as the glass transition temperature of the alloy of the strip, the glass transition temperature not only varies with the alloy composition but also is often difficult to exactly determine, particularly in amorphous alloys. Thus, the upper limit of the quenching temperature range is specified as 500° C. When the lower limit of the quenching temperature range is higher than 200° C., the quenched strip is locally poor in toughness, so that the bending fracture strain $\epsilon_f$ fluctuates and cannot be greater than 0.1. Therefore, the quenching temperature range is specified as from 500 to 200° C.

If the quenching in this temperature range is carried out at a cooling rate less than $10^{3°}$ C./sec, the quenched strip is locally poor in toughness, so that the bending fracture strain $\epsilon_f$ fluctuates and cannot be greater than 0.1. This trend becomes more significant as the strip thickness increases. Therefore, the solidified strip must be quenched at a cooling rate of $10^{3°}$ C./sec or more in the temperature range of from 500 to 200° C.

The bending fracture strain $\epsilon_f$ must be greater than 0.1 in order to prevent the strip from breaking during the fabrication of transformers or the like.

The high toughness, thick amorphous alloy strip of the present invention may be produced by applying a molten metal alloy on to a rotating roll through a multiple slot nozzle having plural slots as shown in FIGS. 1(A), 1(B), and 1(C), in which numeral 1 denotes a slot or opening of nozzle, and symbols "a", "b", and "l" denote the spacing between the slots 1, the width, and the length of the slot 1, respectively. The roll is made of a material having good heat conductivity. The roll may be replaced by a cylinder belt or the like. The use of a multiple slot nozzle ensures that a molten metal puddle is stably maintained on the roll surface. Moreover, a solidified shell formed on the upstream side with respect to the roll rotation direction is pressed against the roll surface by the pressure of the molten metal stream ejected from the slot disposed on the downstream side, so that the molten metal, or the solidified shell, is kept in contact with the roll surface for an elongated time. This increases the cooling rate and enables a thick amorphous alloy strip to be produced.

The cooling rate can be monitored during casting or solidification by a contact-type thermometer disclosed in Japanese Unexamined Patent Publication (Kokai) No. 59-64144, for example. Specifically, to control the cooling rate, the temperature must be measured at at least two points on the free surface of the alloy strip being cast.

Figure 2:
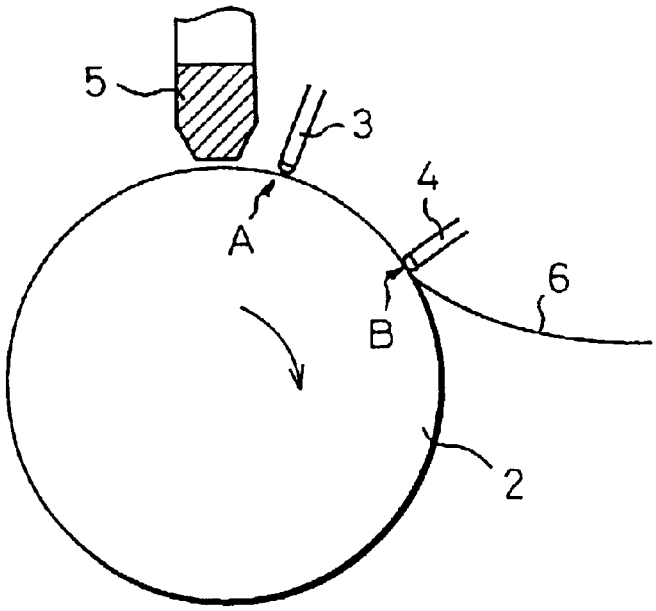
FIG. 2 shows an arrangement for measuring the strip temperature in a single roll quenching process according to the present invention, in a sectional view.

FIG. 2 shows an example of an arrangement for measuring the temperature of the strip being cast according to the present invention, in which numeral 2 denotes a cooling roll, 3 and 4 contact-type thermocouples, 5 a molten metal alloy, and 6 a solidified strip. The temperature is measured on the strip 6 in the portion held in close contact with the surface of the cooling roll 2. The temperatures are measured at the middle of the strip width at a higher temperature point A and a lower temperature point B. The strip temperatures on the other portions of the strip can be estimated by extrapolating the temperatures measured at points A and B. By using this method, an average cooling rate in the temperature range of from 500° C. to 200° C. can be determined.

The specified average cooling rate of $10^{3°}$ C./sec in the temperature range of from 500 to 200° C. is the critical lower limit to provide significant improvement of the bending fracture strain of an Fe-based amorphous alloy strip having a thickness of more than 55 $\mu$m up to 100 $\mu$m.

In the mass production of alloy strips, a strip quenched and solidified on a cooling roll must be continuously coiled. The present inventors found that, when the solidified strip is coiled at a temperature higher than 200° C., the heat accumulated in the strip coil causes structure relaxation of the strip to occur and thereby lowers the degree of amorphization, with the result that the toughness of the strip is reduced such that the bending fracture strain $\epsilon_f$ is equal to or less than 0.1 when the strip has a thickness of more than 55 $\mu$m up to 100 $\mu$m and a width of 20 mm or more, the fracture strain $\epsilon_f$ being determined by bending a strip with the free surface facing outward. Therefore, to prevent the toughness from being reduced, the solidified strip must be coiled at a temperature of not higher than 200° C. The thus-specified coiling temperature first makes it possible to provide a high toughness, Fe-based amorphous alloy strip having a thickness of more than 55 $\mu$m up to 70 $\mu$m and a bending fracture strain $\epsilon_f$ equal to 1, which means that a strip can be bent completely on itself in the form of a folio.

The specified quenching at a cooling rate equal to or higher than the critical value of $10^{3°}$ C. /sec can be realized by the following method. When the quenching is effected by a single, cooling roll alone, either the strip is kept in close contact with the roll surface until the temperature of the free surface of the strip becomes 200° C. or lower, or a secondary cooling is effected after the strip is detached from the roll surface. The secondary cooling can be effected either by using a secondary roll or by blowing a cold gas onto the strip so that the strip is quenched at a cooling rate greater than $10^{3°}$ C./sec to a temperature of 200° C. or lower. Further, the secondary cooling may be carried out by water-cooling and thereafter drying the strip. To provide as high a cooling rate as possible, the time of contact between the strip and the roll surface is advantageously elongated by using a cooling roll having a large diameter.

The alloy according to the present invention may contain elements such as Fe, Co, Ni and other transition metals and one or more of B, Si, C, P and other metalloid elements. Part of Fe, Co, and Ni may be replaced by other metals such as Mo, Cr, Nb, Ta, Ti, Al, Cu, Zr, Sn, and Mn.

The present invention will now be described in more detail with reference to the following working examples.

EXAMPLE 1

25 mm wide alloy strips were produced by single roll quenching process. A double slot nozzle and a triple slot nozzle (width d=0.4 mm, length 1=25 mm, interval a=1 mm) were used. A molten metal alloy was ejected through the nozzle and applied onto a 580 mm diameter copper roll rotating at a speed of 700 rpm. The strip thickness was adjusted by varying the ejection pressure of the molten metal alloy. The alloy composition was $Fe_{80.5}Si_{6.5}B_{12}C_1$ in atomic percentage. The coiling temperature was adjusted by varying the position at which the strip was detached from the roll surface by using a gas blow separation. The temperature of the free surface of the strip being quenched on the roll surface was measured by a contact-type thermocouple at two points and the measured temperatures were used to estimate the average cooling rate in the temperature range of from 500° C. to 200° C.

The thus-produced strips were tested by bending with the free surface facing outward and the results obtained are summarized in Table 1.

TABLE 1

| | Strip thickness ($\mu$m) | 500–200° C. average cooling rate (° C./sec) | Coiling temperature (° C.) | Bending fracture strain ($\epsilon_f$) |
|---|---|---|---|---|
| Invention | 60 | $3.5 \times 10^4$ | 135 | 1 |
| | 67 | $1 \times 10^4$ | 180 | 1 |
| | 70 | $1 \times 10^4$ | 190 | 1 |
| | 74 | $5 \times 10^3$ | 185 | 0.58–0.8 |
| Comparison | 60 | $2 \times 10^4$ | 320 | 0.006–0.02 |
| | 58 | $2.5 \times 10^4$ | 310 | 0.008–0.02 |
| | 57 | $<1 \times 10^3$ | 260 | 0.01–0.03 |

EXAMPLE 2

25 mm wide alloy strips were produced by single roll quenching process in the same manner as used in Example 1. The strip thickness was adjusted by varying the ejection pressure of molten metal alloy and the revolution of cooling roll. A triple slot nozzle and a four-slot nozzle were used. The temperature of the free surface of the strip being quenched on the roll surface was measured by a contact-type thermocouple in order to control the average cooling rate in the temperature range of from 500 to 200° C. to be $10^{3°}$ C./sec or more and the coiling temperature to be 200° C. or less. For the thicker strips, auxiliary coolin media such as auxiliary cooling gas or an auxiliary cooling roll were used to ensure a sufficient cooling rate within the specified range. The alloy composition was $Fe_{80.5}Si_{6.5}Bi_{12}C_1$ in atomic percentage.

The thus-produced strips were tested by bending with the free surface facing outward and the results obtained are summarized in Table 2.

TABLE 2

| | Strip thickness ($\mu$m) | 500–200° C. average cooling rate (° C./sec) | Coiling temperature (° C.) | Bending fracture strain ($\epsilon_f$) |
|---|---|---|---|---|
| Invention | 78 | $4.5 \times 10^3$ | 185 | 0.31–0.4 |
| | 82 | $4.5 \times 10^3$ | 190 | 0.2–0.37 |
| | 90 | $2.0 \times 10^3$ | 195 | 0.12–0.21 |
| | 100 | $1.5 \times 10^3$ | 195 | 0.11–0.17 |

Figure 3:
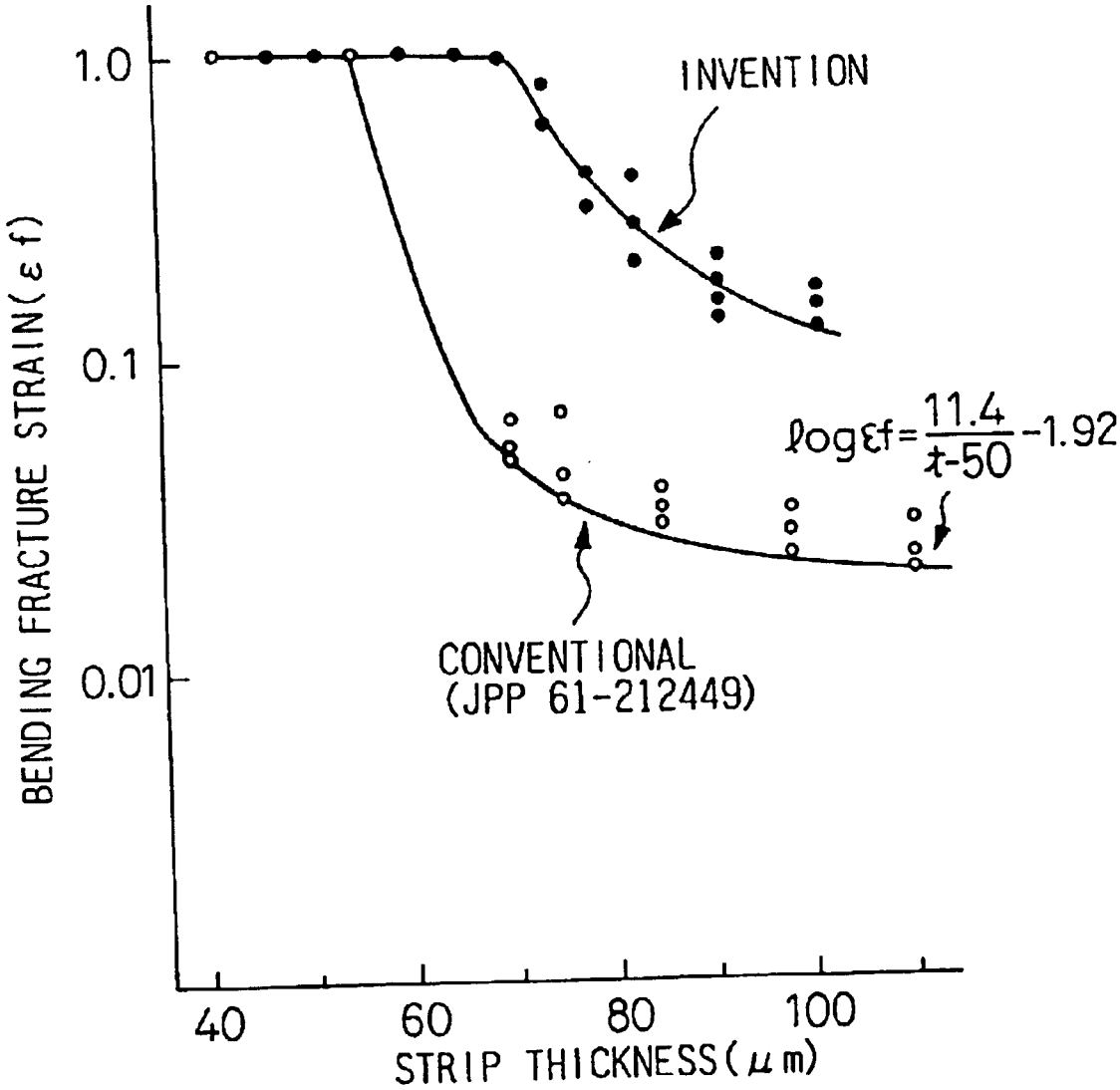
FIG. 3 is a graph showing the relationship between the strip thickness and the bending fracture strain for the amorphous alloy strips according to the present invention in comparison with the conventional strips.

FIG. 3 summarizes the results obtained in Examples 1 and 2.

As described above, the present invention provides a amorphous alloy strip having a bending fracture strain $\epsilon_f$ satisfying the relationship $\epsilon_f>0.1$ when it has a thickness of more than 55 $\mu$m up to 100 $\mu$m or satisfying the relationship $\epsilon_f=1$ when it has a thickness of more than 55 $\mu$m up to 70 $\mu$m, the bending fracture strain being determined by bending the strip with the free surface facing outward.

EXAMPLE 3

25 mm wide alloy strips were produced by single roll quenching process in the same manner as used in Example 1. The strip thickness was adjusted by varying the ejection pressure of molten metal alloy and the revolution of cooling roll. A double slot nozzle and a triple slot nozzle were used. The position at which the solidified strip is detached from the cooling roll surface was adjusted by a detaching gas so that the detaching temperature of the strip was controlled at 350° C. After being detached from the cooling roll surface, the strip was further cooled by both a secondary cooling and conveying roll disposed near the cooling roll and by a cooling gas blown between the cooling roll and the secondary cooling roll. The temperature of the free surface of the strip being quenched on the roll surface was measured by a contact-type thermocouple in order to control the average cooling rate in the temperature range of from 500 to 200° C. to be $10^{3}$° C./sec or more and the coiling temperature to be 200° C. or less. The coiling temperature was the strip temperature measured at the position of a coiling roll. The alloy composition was $Fe_{80.5}Si_{6.5}B_{12}C_1$ in atomic percentage.

The thus-produced strips were tested by bending with the free surface facing outward and the results obtained are summarized in Table 3.

TABLE 3

| | Strip thickness ($\mu$m) | 500–200° C. average cooling rate (° C./sec) | Coiling temperature (° C.) | Bending fracture strain ($\epsilon_f$) |
|---|---|---|---|---|
| Invention | 58 | $2.0 \times 10^4$ | 180 | 1 |
| | 68 | $6.7 \times 10^3$ | 185 | 1 |
| | 77 | $3.8 \times 10^3$ | 180 | 0.29–0.38 |
| | 83 | $1.8 \times 10^3$ | 195 | 0.18–0.34 |

It should be noted that the results obtained in Example 3 also fit well with the results according to the present invention shown in FIG. 3.

As described above, the present invention provides an amorphous alloy strip having a remarkably improved bending fracture toughness.

According to the Fe-based amorphous alloy strip, or the process of producing same, of the present invention, it is possible to produce a wide and thick, high toughness amorphous alloy strip having an improved bending fracture strain. Moreover, the strip can be slitted without any problem. The strip is advantageously used as a coiled core of transformer or the like and has a wide application field because of its easy handling.

What is claimed is:

1. A high toughness iron-based amorphous alloy strip having a thickness of not less than 58 $\mu$m up to 70 $\mu$m and a width of 20 mm or more and having a fracture strain $\epsilon_f$ satisfying the following relationship:

$$\epsilon_f=1,$$

where $\epsilon_f=t/(D-t)$, t=thickness of said strip, and

D=bent diameter upon fracture, $\epsilon_f$ being determined by bending said strip with a free cooling surface thereof facing upward.

2. A high toughness iron-based amorphous alloy strip having a thickness of more than 70 $\mu$m up to 100 $\mu$m and a width of 20 mm or more and having a fracture strain $\epsilon_f$ satisfying the following relationship:

$$\epsilon_f>0.17,$$

where $\epsilon_f=t/(D-t)$, t=thickness of said strip, and

D=bent diameter upon fracture, $\epsilon_f$ being determined by bending said strip with a free cooling surface thereof facing upward.

* * * * *

UNITED STATES PATENT AND TRADEMARK OFFICE

CERTIFICATE OF CORRECTION

PATENT NO. : 6,830,636 B2
DATED : December 14, 2004
INVENTOR(S) : Hiroaki Sakamoto et al.

It is certified that error appears in the above-identified patent and that said Letters Patent is hereby corrected as shown below:

Column 4,
Line 33, change “quenchin” to -- quenching --; and

Column 6,
Line 60, change “coolin” to -- cooling --.

Signed and Sealed this

Eighteenth Day of October, 2005

JON W. DUDAS
*Director of the United States Patent and Trademark Office*